US008178036B2

(12) United States Patent
Neff et al.

(10) Patent No.: US 8,178,036 B2
(45) Date of Patent: May 15, 2012

(54) IMPELLER FOR DISPERSING GAS INTO MOLTEN METAL

(75) Inventors: David Neff, Willoughby, OH (US); Richard S. Henderson, Solon, OH (US); Lennard D. Lutes, Copley, OH (US); James Grayson, Gurdon, AR (US)

(73) Assignee: Pyrotek, Inc., Spokane, WA (US)

( * ) Notice: Subject to any disclaimer, the term of this patent is extended or adjusted under 35 U.S.C. 154(b) by 275 days.

(21) Appl. No.: 12/373,535

(22) PCT Filed: Jul. 13, 2007

(86) PCT No.: PCT/US2007/073465

§ 371 (c)(1), (2), (4) Date: Oct. 12, 2009

(87) PCT Pub. No.: WO2008/008956

PCT Pub. Date: Jan. 17, 2008

(65) Prior Publication Data

US 2010/0052227 A1 Mar. 4, 2010

Related U.S. Application Data

(60) Provisional application No. 60/830,647, filed on Jul. 13, 2006.

(51) Int. Cl.
*C21C 7/00* (2006.01)

(52) U.S. Cl. ..... 266/235; 266/233

(58) Field of Classification Search ..... 266/233, 266/235

See application file for complete search history.

(56) References Cited

U.S. PATENT DOCUMENTS

| | | | | |
|---|---|---|---|---|
| 3,411,759 | A * | 11/1968 | Rapson | 261/91 |
| 4,898,367 | A | 2/1990 | Cooper | |
| 5,143,357 | A * | 9/1992 | Gilbert et al. | 266/235 |
| 5,310,412 | A | 5/1994 | Gilbert et al. | |
| 5,364,078 | A | 11/1994 | Pelton | |
| 5,660,614 | A | 8/1997 | Waite | |
| 6,056,803 | A | 5/2000 | Waite | |

* cited by examiner

*Primary Examiner* — Scott Kastler
(74) *Attorney, Agent, or Firm* — Fay Sharpe LLP

(57) ABSTRACT

An impeller for dispersing gas into molten metal includes a rectangular prism body having upper and lower faces and four side walls. The body has an opening extending through the upper and lower faces and defines a hub around the opening on the upper face. The impeller further includes a plurality of elongate grooves extending radially outwardly from the hub.

20 Claims, 7 Drawing Sheets

IMPELLER FOR DISPERSING GAS INTO MOLTEN METAL

This application claims priority to Provisional Application Ser. No. 60/830,647 filed Jul. 13, 2006.

BACKGROUND

The invention relates to dispersing gas into molten metal and, more particularly, to techniques for causing finely divided gas bubbles to be dispersed uniformly throughout the molten metal.

In the course of processing molten metals, it sometimes is necessary to treat the metals with gas. For example, it is customary to introduce process gases such as nitrogen and argon into molten aluminum and molten aluminum alloys in order to remove undesirable constituents such as hydrogen gas, non-metallic inclusions, and alkali metals. The process gases added to the molten metal chemically react with the undesired constituents to convert them to a form (such as a precipitate or a dross) that can be separated readily from the remainder of the molten metal. In order to obtain the best possible results, it is necessary that the process gas be combined with the undesirable constituents efficiently. Such a result requires that the gas be dispersed in bubbles as small as possible and that the bubbles be distributed uniformly throughout the molten metal. When removal of hydrogen gas is desired, the process gas bubbles allow hydrogen atoms to diffuse into the bubble and form a hydrogen molecule. Then the bubbles rise to the surface where the hydrogen can be released to the atmosphere or to the dross phase or flux cover.

As used herein, reference to "molten metal" will be understood to mean any metal such as aluminum, copper, iron, and alloys thereof, which are amenable to gas purification. Further, the term "gas" will be understood to mean any gas or combination of gases, including argon, nitrogen, chlorine, freon, and the like, that have a purifying effect upon molten metals with which they are mixed.

Heretofore, gases have been mixed with molten metals by injection through stationary members such as lances, or through porous diffusers. Such techniques suffer from the drawback that inadequate dispersion of the gas throughout the molten metal can occur. In order to improve the dispersion of the gas throughout the molten metal, rotating injectors are commonly used, which provide shearing action of the gas bubbles and intimate stirring/mixing of the process gas with the liquid metal.

Despite the existence of combined rotating/injecting devices, certain problems remain. Combined devices often exhibit poor mixing action. Sometimes cavitation occurs or a vortex is established that moves around the inside of the vessel within which the molten metal is contained. Frequently these devices dispense bubbles that are too large or which are not uniformly distributed throughout the molten metal. A problem with one known prior device is that it utilizes an impeller having passageways that can be clogged with dross or foreign objects. Most of the prior devices are expensive, complex, and usable with only one type of molten metal refining system. Other problems frequently encountered are poor longevity of the devices due to oxidation, erosion, or lack of mechanical strength. These latter concerns are particularly troublesome in the case of aluminum because the rotating/injecting devices usually are made of graphite, and graphite is subject to ongoing oxidation and is eroded by molten aluminum. Accordingly, devices that initially perform adequately often become quickly oxidized and eroded so that their mixing and gas dispersing effectiveness diminishes rapidly; in severe cases, complete mechanical failure can occur.

The particular impeller disclosed here has proven very effective. The impeller is in the form of a rectangular prism having sharp-edged corners and multiple grooves that provides an especially effective mixing action.

SUMMARY

In a first embodiment, an impeller for dispersing gas into molten metal includes a rectangular prism body having upper and lower faces and four side walls. The body has an opening extending through the upper and lower faces and defines a hub around the opening on the upper face. The impeller further includes a plurality of elongate grooves extending radially outwardly from the hub. Each groove has a longitudinal axis parallel to a greatest dimension of the groove. Each groove is disposed on the upper face and the longitudinal axes being colinear with a radius of the opening.

According to another embodiment, an impeller for dispersing gas into molten metal includes an impeller body having a first face, a second face spaced from the first face, sidewalls extending between the first face and the second face, and an opening extending through the body between the first face and the second face. The impeller further includes grooves extending into the body from the first face toward the second face and terminating above the second face. Each groove extends from a central portion of the impeller body to a side wall. Each side wall is intersected by at least two grooves.

According to another embodiment, an impeller for dispersing gas into molten metal includes a first face, a second face spaced from the first face, side walls extending between the first face and the second face, and an opening extending through the body between the first face and the second face. The impeller further includes grooves extending into the body from the first face toward the second face and terminating above the second face and defining a symmetrical axis along a longest dimension of each groove. Each groove has a substantially constant cross-sectional area along a majority of the symmetrical axis.

DETAILED DESCRIPTION

This application incorporates by reference U.S. Pat. No. 4,898,367 and U.S. Pat. No. 5,143,357.

Figure 1:
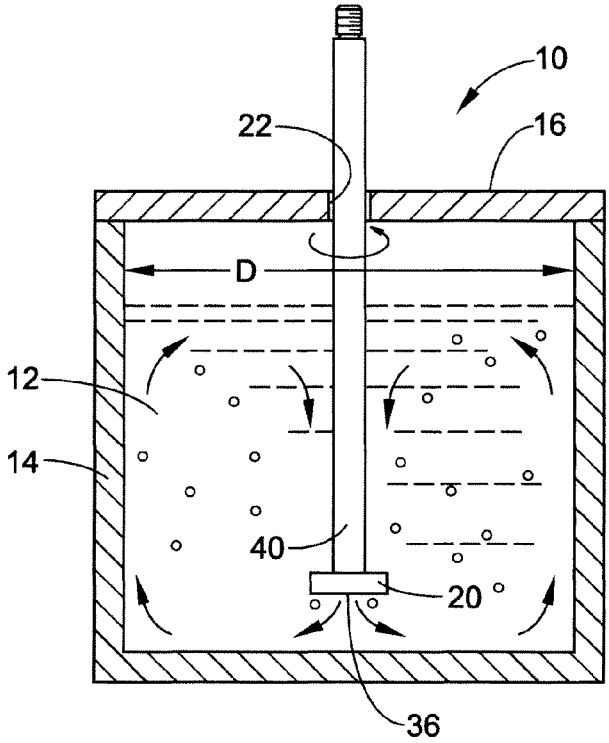
FIG. 1 is a cross-sectional view of a vessel containing molten metal into which gas dispersing apparatus has been immersed.
Figure 2:
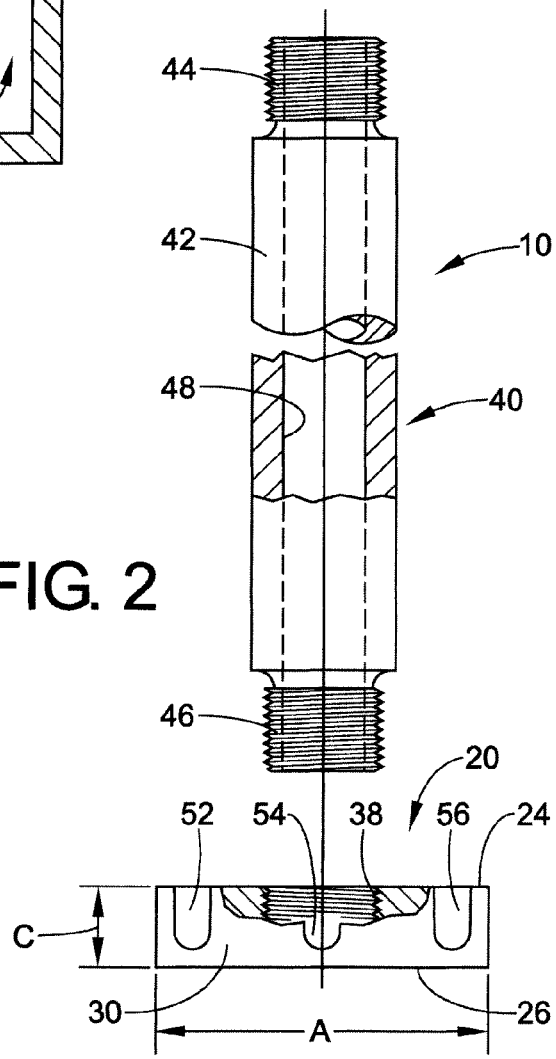
FIG. 2 is an enlarged view of the dispersing apparatus of FIG. 1, with an impeller and a shaft being illustrated in spaced relationship.
Figure 3:
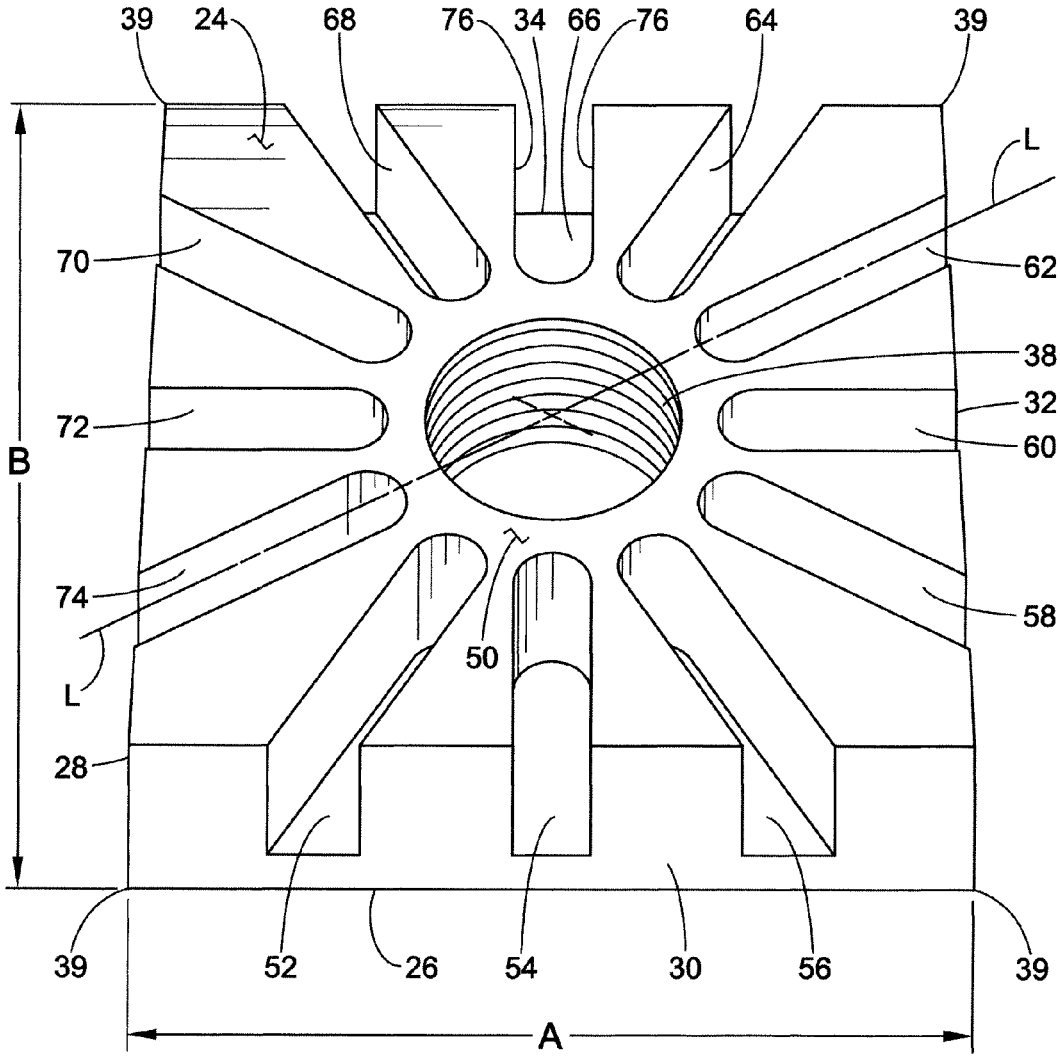
FIG. 3 is a perspective view of the impeller of FIG. 2.

The present invention is directed to a more efficient impeller. The apparatus 10 can be used in a variety of environments, and a typical one will be described here. Referring to FIGS. 1-3, a gas injection device according to the invention is indicated generally by the reference numeral 10. The device 10 is adapted to be immersed in molten metal 12 contained within a vessel 14. The vessel 14 is provided with a removable cover 16 in order to prevent excessive heat loss from the upper surface of the molten metal 12. The vessel 14 can be provided in a variety of configurations, such as cubic or cylindrical. For purposes of the present description, the vessel 14 will be described as cylindrical, with an inner diameter indicated by the letter D in FIG. 1. For non-cylindrical applications, the letter D will identify that dimension defining the average inner diameter of the vessel 14.

The apparatus 10 includes an impeller 20 and a shaft 40. The impeller 20 and the shaft 40 usually will be made of graphite, particularly if the molten metal being treated is aluminum. If graphite is used, it preferably should be coated or otherwise treated to resist oxidation and erosion. Oxidation and erosion treatments for graphite parts are practiced commercially, and can be obtained from sources such as Metaullics Systems, 31935 Aurora Road, Solon, Ohio 44139.

As is illustrated in FIG. 1, the shaft 40 is an elongate member that is rigidly connected to the impeller 20 and which extends out of the vessel 14 through an opening 22 provided in the cover 16. As seen in FIG. 3, the impeller 20 is in the form of a rectangular prism having an upper face 24, a lower face 26, and side walls 28, 30, 32, 34. The impeller 20 includes a gas discharge outlet 36 opening through the lower face 26. In the preferred embodiment, the gas discharge outlet 36 (FIG. 1) constitutes a portion of a threaded opening 38 that extends through the impeller 20 and which opens through the upper and lower faces 24, 26. The faces 24, 26 are approximately parallel with each other as are the side walls 28, 32 and the side walls 30, 34. The faces 24, 26 and the side walls 28, 30, 32, 34 are planar surfaces which define sharp, right-angled corners 39.

As shown in FIGS. 2 and 3, the side walls 30, 34 have a width identified by the letter A, while the side walls 28, 32 have a depth indicated by the letter B. The height of the impeller 20, that is, the distance between the upper and lower faces 24, 26, is indicated by the letter C. Preferably, dimension A is approximately equal to dimension B, and dimension C is approximately equal to ⅓ dimension A. Deviations from the foregoing dimensions are possible, but best performance will be attained if dimensions A and B are approximately equal to each other (the impeller 20 is square in plan view), and if the corners 39 are sharp and approximately right-angled. Also, the corners 39 should extend approximately perpendicular to the lower face 26 at least for a short distance above the lower face 26.

As illustrated, corners 39 are approximately perpendicular to the lower face 26 completely to their intersection with the upper face 24. It is possible, although not desirable, that the upper face 24 could be larger or smaller than the lower face 26 or that the upper face 24 could be skewed relative to the lower face 26; in either of these cases, the corners 39 would not be approximately perpendicular to the lower face 26. The best performance is attained when the corners 39 are exactly perpendicular to the lower face 26. It also is possible that the impeller 20 could be triangular, pentagonal, or otherwise polygonal in plan view, but it is believed that any configuration other than a rectangular, square prism exhibits reduced bubble-shearing and bubble-mixing performance.

The dimensions A, B, and C also should be related to the dimensions of the vessel 14, if possible. In particular, the impeller 20 has been found to perform best when the impeller 20 is centered within the vessel 14 and the ratio of dimensions A and D is within the range of 1:6 to 1:8. Although the impeller 20 will function adequately in a vessel 14 of virtually any size or shape, the foregoing relationships are preferred.

The impeller 20 also has a threaded opening 38 extending through the center of the upper 24 and lower faces 26 of the impeller 20. The impeller 20 further includes a central portion, or hub, 50 that forms a portion of the upper face 24 at the center thereof. A plurality of grooves 52, 54, 56, 58, 60, 62, 64, 66, 68, 70, 72, 74 extend radially outwardly from the hub 50. The grooves 52, 54, 56, 58, 60, 62, 64, 66, 68, 70, 72, 74 are disposed on the upper face 24. Each of the grooves 52, 54, 56, 58, 60, 62, 64, 66, 68, 70, 72, 74 includes a pair of opposed parallel sidewalls 76. Each groove extends from the hub to a respective side wall and the respective groove is open at the side wall. In the depicted embodiment each side wall is intersected by three grooves.

As is apparent from an examination of FIG. 3, the grooves 52, 54, 56, 58, 60, 62, 64, 66, 68, 70, 72, 74 extend into the body of the impeller 20 from the upper face 24 and have a lower surface that is spaced from and generally parallel to the upper face and the lower face 26. The grooves 52, 54, 56, 58, 60, 62, 64, 66, 68, 70, 72, 74 are disposed at approximately equal angles to each other, that is, any given groove is disposed equidistantly between adjacent grooves. Moreover, the grooves 52, 54, 56, 58, 60, 62, 64, 66, 68, 70, 72, 74 include longitudinal axes L (which is also a symmetrical axis) that are aligned with each other and that extend from one side to the opposed side (one axis for two grooves, each on an opposite side of the threaded opening 38). The longitudinal axes L are parallel to a greatest dimension of each groove and are colinear with the radius of the threaded opening 38 (i.e. extend through the center of the threaded opening). The outermost (distal) end of each groove is generally square or rectangular in a cross section taken normal to the longitudinal axis. Each groove is rounded at its innermost (proximal) end. The cross-sectional area taken normal to the longitudinal axis remains constant from the distal end of the groove to where the rounded proximal end begins. The cross-sectional area remains constant for greater than a majority of the length of the longitudinal axis.

With reference back to FIG. 2, the shaft 40 includes an elongate, cylindrical center portion 42 from which threaded upper and lower ends 44, 46 project. The shaft 40 includes a longitudinally extending bore 48 that opens through the ends of the threaded portions 44, 46. The shaft 40 can be machined from graphite rod stock or fabricated from a commercially available flux tube, or gas injection tube, merely by machining threads at each end of the tube. A typical flux tube suitable for use with the present invention has an outer diameter of 2.875 inches, a bore diameter of 0.75 inch, and a length dependent upon the depth of the vessel.

As is illustrated in the Figures, the lower end 46 is threaded into the opening 38 formed in the hub 50 until a shoulder defined by the cylindrical portion 42 engages the upper face 24. The use of coarse threads (2.5-4 inch pitch, UNC) facilitates manufacture and assembly. If desired, the shaft 40 could be rigidly connected to the impeller 20 by techniques other than a threaded connection, such as cemented or pinned which strengthens the connection if desired.

The threaded end 44 is connected to a rotary drive mechanism (not shown) and the bore 48 is connected to a gas source (not shown). Upon immersing the impeller 20 in molten metal and pumping gas through the bore 48, the gas will be discharged through the opening 36 in the form of large bubbles that flow outwardly along the lower face 26. Upon rotation of the shaft 40, the impeller 20 will be rotated. Assuming that the gas has a lower specific gravity than the molten metal, the gas bubbles will rise as they clear the lower edges of the side walls 28, 30, 32, 34. Eventually, the gas bubbles will be contacted by the sharp corners 39. The bubbles will be sheared into finely divided bubbles which will be thrown outwardly and thoroughly mixed with the molten metal 12 which is being churned within the vessel 14. In the particular case of the molten metal 12 being aluminum and the treating gas being nitrogen or argon, the shaft 40 should be rotated within the range of 200-400 revolutions per minute. Because there are four corners 39, there will be 800-1600 shearing edge revolutions per minute.

By using the apparatus according to the invention, high volumes of gas in the form of finely divided bubbles can be pumped through the molten metal 12, and the gas so pumped will have a long bubble residence time by means of the impeller of this invention. The apparatus 10 can pump gas at nominal flow rates of 1 to 2 cubic feet per minute (cfm) easily without choking. The apparatus 10 is very effective at dispersing gas and mixing it with the molten metal 12. The invention is exceedingly inexpensive and easy to manufacture, while being adaptable to all types of molten metal rotating refining systems. The apparatus 10 does not require accurately machined, intricate parts, and it thereby has greater resistance to oxidation and erosion, as well as enhanced mechanical strength, all of which provides longer life capability in service. Because the impeller 20 and the shaft 40 present solid surfaces to the molten metal 12, there are no orifices or channels that can be clogged by dross or foreign objects.

When the apparatus 10 is being used as a gas-disperser, it is expected that the impeller 20 will be positioned relatively close to the bottom of the vessel within which the apparatus 10 is disposed.

Although the invention as been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

Example Section

The following testing conditions were implemented:

Water tank 48"×48"×31"

Rotors kept 4" from the floor

Oxygen sensor used to measure depletion

Air was pumped back in after every test to have a uniform starting point for oxygen content Nitrogen was used to displace the oxygen during "degassing"

Standard conditions:

RPM: 250, 325, 400

Flow (scfh): 30, 60, 90

Figure 4:
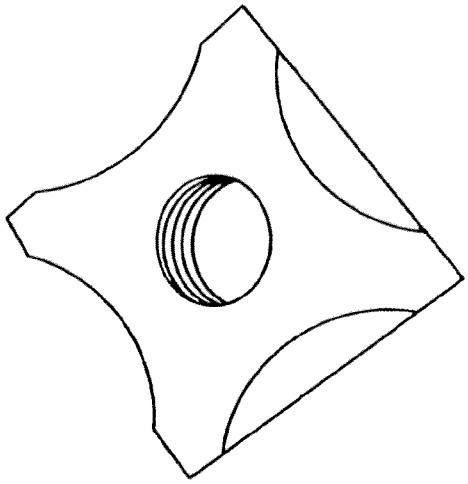
FIG. 4 PRIOR ART
FIGS. 4-14 are views of other impellers that were tested (FIGS. 4 and 6 being plan views and the remainder being perspective views)
Figure 5:
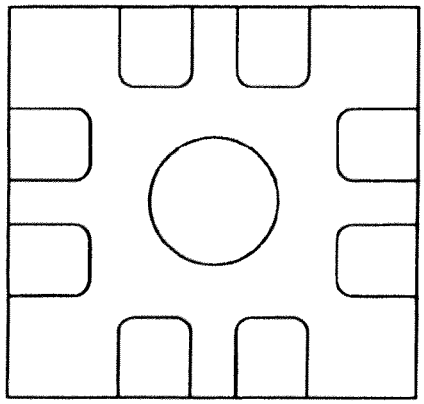
FIG. 5 PRIOR ART
Figure 6:
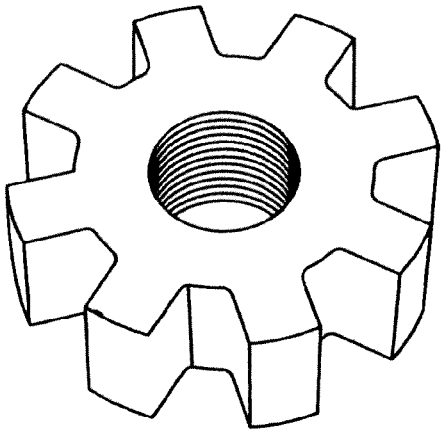
FIG. 6 PRIOR ART
Figure 7:
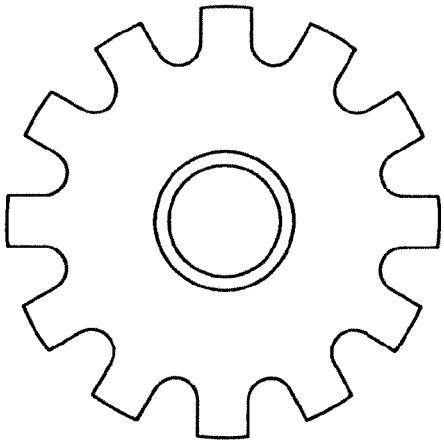
FIG. 7 PRIOR ART
Figure 8:
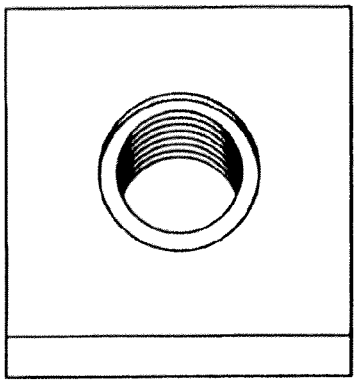
FIG. 8 PRIOR ART
Figure 9:
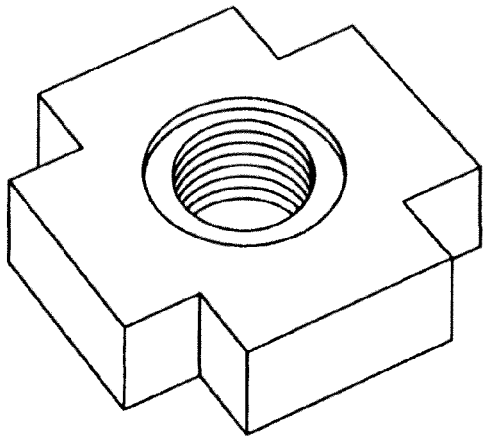
FIG. 9 PRIOR ART
Figure 10:
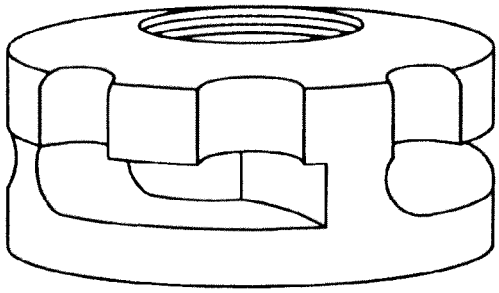
FIG. 10 PRIOR ART
Figure 11:
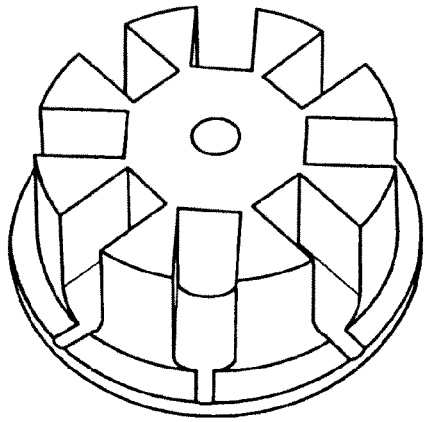
FIG. 11 PRIOR ART
Figure 12:
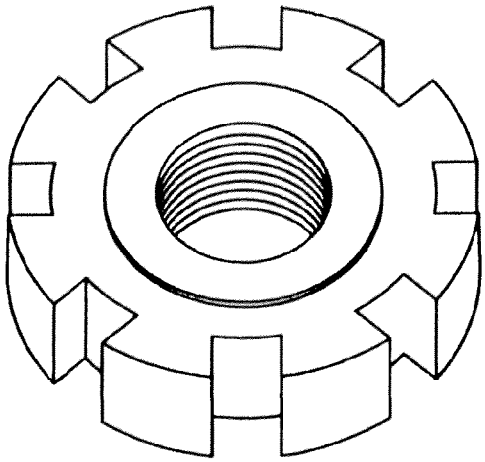
FIG. 12 PRIOR ART
Figure 13:
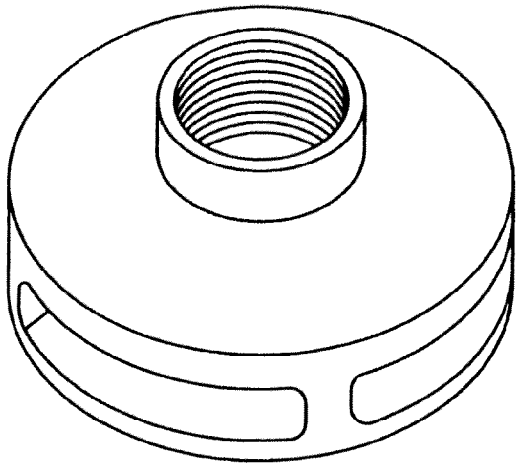
FIG. 13 PRIOR ART
Figure 14:
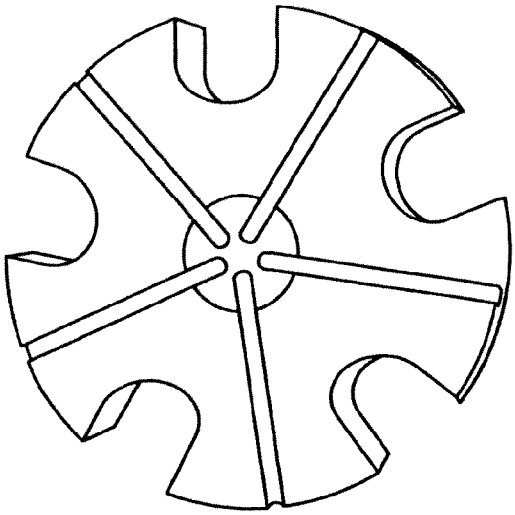
FIG. 14 PRIOR ART
Figure 15:
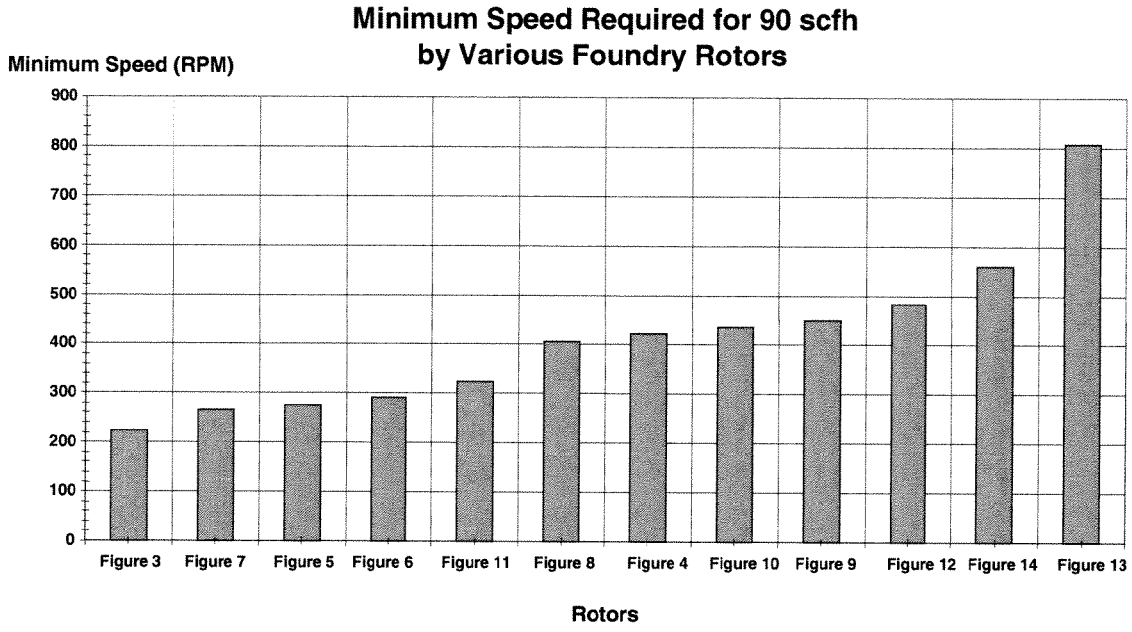
FIG. 15 is a graph depicting minimum speed (RPM) required for 90 scfh for the impellers depicted in FIGS. 3-14.
Figure 16:
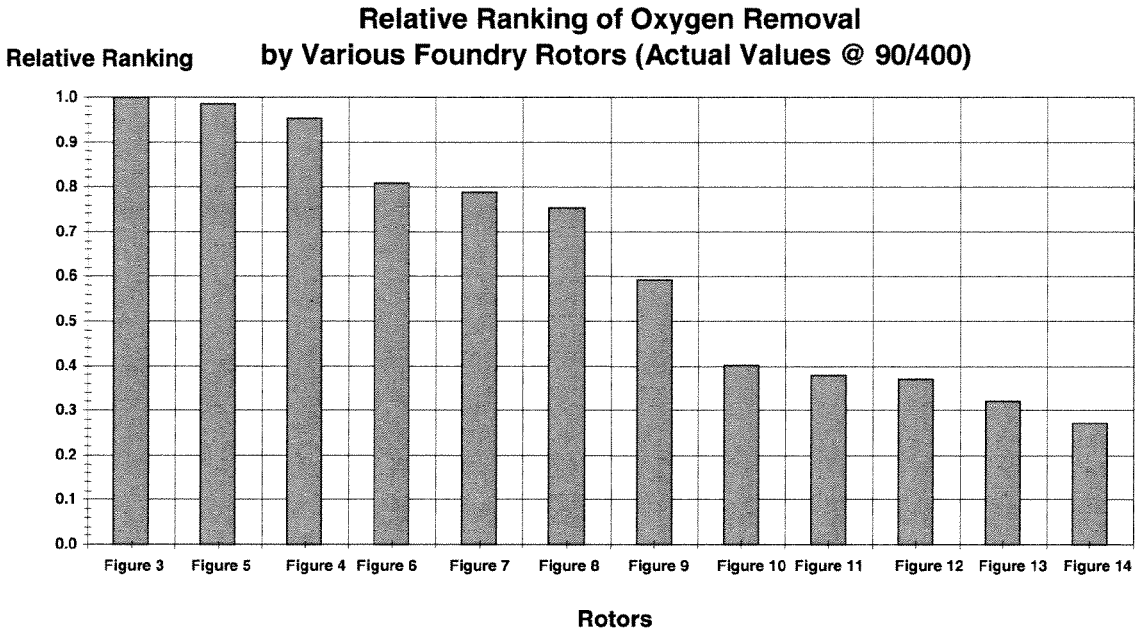
FIG. 16 is a graph depicting relative rankings of oxygen removal for the impellers depicted in FIGS. 3-14.

| | Width | | | | Minimum RPM Flow for | | |
|---|---|---|---|---|---|---|---|
| Rotor | Side to Side | Corner to Corner | Diameter | Height | 30 scfh | 60 scfh | 90 scfh |
| FIG. 3 | 7" | 10" | | 2.25" | 150 RPM | 175 RPM | 200 RPM |
| FIG. 4 | 7" | 10" | | 2.0" | 300 RPM | 325 RPM | 350 RPM |
| FIG. 5 | 7" | 10" | | 2.25" | 175 RPM | 225 RPM | 250 RPM |
| FIG. 6 | | | 8" | 2.44" | 200 RPM | 225 RPM | 250 RPM |
| FIG. 7 | | | 9" | 2.0" | 175 RPM | 200 RPM | 250 RPM |
| FIG. 8 | 7" | 10" | | 2.0" | 225 RPM | 350 RPM | 400 RPM |
| FIG. 9 | 8.5" | | | 2.0" | 300 RPM | 350 RPM | 400 RPM |
| FIG. 10 | | | 7.5" | 3.5" | 275 RPM | 350 RPM | 400 RPM |
| FIG. 11 | | | 6" Body 7" Cap | 3.0" | 225 RPM | 250 RPM | 275 RPM |
| FIG. 12 | | | 7" | 2.0" | 325 RPM | 375 RPM | 425 RPM |
| FIG. 13 | | | 7.5" | 3.5" | 525 RPM | 575 RPM | 650+ RPM [max. motor speed) |
| FIG. 14 | | | 6" | 3.5" | 300 RPM | 400 RPM | 600 RPM |

The foregoing results demonstrate superior performance with the rotor known as the "modified STAR". This rotor is shown as FIG. 3. Because of the 'dynamic similarity' between water and aluminum fluids, i.e. they have similar kinematic viscosities, trends in degassing efficiency in molten aluminum will follow the results exhibited in oxygen depletion in water modeling, that is the rotors will be expected to perform in the same relative comparison to one another. The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. An impeller for dispersing gas into molten metal comprising a rectangular prism body having upper and lower faces and four sidewalls, the body having an opening extending through the upper and lower faces and defining a hub around the opening on the upper face, the impeller further including a plurality of elongate grooves extending radially outwardly from the hub each groove having a longitudinal axis parallel to a greatest dimension of the groove, each groove being disposed on the upper face and the longitudinal axes being colinear with a radius of the opening.

2. The impeller of claim 1, wherein the longitudinal axis of at least two grooves align with a diameter of the opening.

3. The impeller of claim 1, wherein each groove is equidistantly angularly spaced between adjacent grooves.

4. The impeller of claim 1, wherein the impeller body includes at least five grooves.

5. The impeller of claim 4, wherein the impeller body includes at least 12 grooves.

6. The impeller of claim 1, wherein the longitudinal axis of each groove aligns with a radius of the opening.

7. The impeller of claim 1, wherein the opening is threaded.

8. The impeller of claim 1, wherein each groove has a substantially constant cross-sectional area taken normal to the longitudinal axis along a majority of the longitudinal axis.

9. In combination, an elongate rotatable shaft connected to the impeller of claim 1, the shaft projecting from the upper face of the impeller and having first and second ends, the first end configured to connect to an associated source of gas and the second end being received in the opening in the impeller, the shaft having a longitudinally extending bore in fluid communication with the opening in the impeller, whereby gas to be dispersed into molten metal can be delivered through the shaft and out of the impeller along the lower face of the impeller.

10. An impeller for dispersing gas into molten metal, the impeller comprising an impeller body including a first face, a second face spaced from the first face, side walls extending between the first face and the second face, and an opening extending through the body between the first face and the second face, the impeller further including grooves extending into the body from the first face toward the second face and terminating above the second face, each groove extending from a central portion of the impeller body to a side wall, wherein each side wall is intersected by at least two grooves.

11. The impeller of claim 10, wherein the body has a rectangular prism configuration.

12. The impeller of claim 10, wherein each side wall is intersected by at least three grooves.

13. The impeller of claim 10, wherein each side wall is intersected by a groove having a symmetrical axis perpendicular to the side wall.

14. The impeller of claim 10, wherein the first face is parallel to the second face.

15. The impeller of claim 10, wherein each groove includes a symmetrical axis and a substantially constant cross-sectional area along a majority of the symmetrical axis.

16. In combination, an elongate rotatable shaft connected to the impeller of claim 10, the shaft projecting from the upper face of the impeller and having first and second ends, the first end configured to connect to an associated source of gas and the second end being received in the opening in the impeller, the shaft having a longitudinally extending bore in fluid communication with the opening in the impeller, whereby gas to be dispersed into molten metal can be delivered through the shaft and out of the impeller along the lower face of the impeller.

17. An impeller for dispersing gas into molten metal, the impeller comprising an impeller body including a first face, a second face spaced from the first face, side walls extending between the first face and the second face, and an opening extending through the body between the first face and the second face, the impeller further including grooves extending into the body from the first face toward the second face and terminating above the second face, each groove extending from a central portion of the impeller body to a side wall and defining a symmetrical axis along a longest dimension of each groove, each groove having a substantially constant cross-sectional area along a majority of the symmetrical axis.

18. The impeller of claim 17, wherein each groove has a closed proximal end and an open distal end, the proximal end being curved.

19. The impeller of claim 17, wherein each side wall is intersected by at least two grooves.

20. In combination, an elongate rotatable shaft connected to the impeller of claim 17, the shaft projecting from the upper face of the impeller and having first and second ends, the first end configured to connect to an associated source of gas and the second end being received in the opening in the impeller, the shaft having a longitudinally extending bore in fluid communication with the opening in the impeller, whereby gas to be dispersed into molten metal can be delivered through the shaft and out of the impeller along the lower face of the impeller.

* * * * *